US005262738A

United States Patent [19]

Chandler et al.

[11] Patent Number: 5,262,738

[45] Date of Patent: Nov. 16, 1993

[54] ANTI-MICROPHONIC POWER COUPLING APPARATUS

[75] Inventors: Kirk R. Chandler, Garland; Leon Jinich, Plano; Mark L. Ryland, Allen, all of Tex.

[73] Assignee: Alcatel Network Systems, Inc., Richardson, Tex.

[21] Appl. No.: 850,372

[22] Filed: Mar. 12, 1992

[51] Int. Cl.[5] ..... H01P 5/08

[52] U.S. Cl. ..... 333/33; 333/230; 331/96

[58] Field of Search ..... 333/230, 227, 26, 33, 333/34; 331/96, 107 DP

[56] References Cited

U.S. PATENT DOCUMENTS

| | | | |
|---|---|---|---|
| 3,601,723 | 8/1971 | Johnson | 333/230 X |
| 3,697,893 | 10/1972 | Faustlin et al. | 333/230 X |
| 4,002,943 | 1/1977 | Regan et al. | 333/26 X |
| 4,491,806 | 1/1985 | Reynolds et al. | 331/107 DP X |
| 4,636,751 | 1/1987 | Horn et al. | 331/96 |
| 4,642,523 | 2/1987 | Nakanishi et al. | 333/230 X |
| 4,675,623 | 6/1987 | Nowak et al. | 333/230 X |

*Primary Examiner*—Benny Lee

*Attorney, Agent, or Firm*—Bruce C. Lutz; Dennis O. Kraft

[57] ABSTRACT

A power coupler that is held in place at two different points along its length to substantially eliminate any movement thereof due to vibration of the environment. One of these holding means comprises a piece of dielectric which snugly encloses the coupler to prevent side-to-side movement while still allowing a vertical adjustment of the coupler element through the holding means. A constant impedance equal to that of an electrically connected circuit is maintained along a portion of the coupler by varying passageway opening sizes. The electrical connection to the circuit, which has a threaded terminal comprising a part of the adjustment means and the other holding means eliminates connector insertion loss and signal reflections inherent in prior art signal interfaces between the coupler and an electrical signal receiving circuit.

8 Claims, 1 Drawing Sheet

ANTI-MICROPHONIC POWER COUPLING APPARATUS

TECHNICAL FIELD OF THE INVENTION

The present invention generally relates to power coupling apparatus and more specifically relates in a first embodiment to a power coupler which supplies to an electrical circuit via a threaded electrical connection. Even more specifically, the invention relates in a refined embodiment to a power coupler which is mounted via a threaded electrical terminal and via a dielectric holding means remotely located from the threaded electrical terminal such that the power coupler can be adjusted in a vertical direction using the threaded terminal while being held firmly in place relative side-to-side movement to eliminate microphonic induced signal distortion.

BACKGROUND OF THE INVENTION

Prior art couplers have typically been held in place by a bulkhead holder which can be threadably adjusted in position using lock nuts to vary the distance from a power coupling head to an electromagnetic field generating source. The electrical signal is passed through the center of the bulkhead holder in much the fashion of a shielded cable with the threads being effectively at ground potential. At the end remote from the power head, a shielded electrical cable is typically attached to provide electrical signals to a receiving circuit. While a lock nut of some type is used to prevent any further movement of the coupler, the design has been such that the power coupling head was allowed considerable freedom of movement side-to-side. This movement of the power coupling head through the field can cause a modulation or distortion of the signal that is transmitted from the resonator or oscillator. This distortion must be accounted for or allowed for in the receiving circuitry through the use of filtering or other means of ignoring or eliminating the distortion of the signal.

The design of cabling for the frequencies of interest in one embodiment of the inventive concept is such that the shielding renders it relatively inflexible. Thus, if space is at a premium, there may not be enough room to make the bends to connect from the prior art power coupler to the receiving electrical circuit. This problem may be exacerbated when the electrical circuit is required to be at right angles to the power coupler. Further there is an insertion loss in the signal as it is passed through each connector and the possibility of signal distorting reflections occurs with each discontinuity such as a connector.

OBJECTS OF THE INVENTION

It is thus an object of the present inventive concept to provide an improved power coupler that is anti-microphonic.

It is a further object of the invention to provide improved impedance matching of a power coupler with the elimination of intervening signal distorting intermediate connections.

Other objects and advantages of the present invention will be apparent from a reading of the specification and appended claims in conjunction with the drawings wherein:

DETAILED DESCRIPTION OF THE INVENTION

Figure 1:
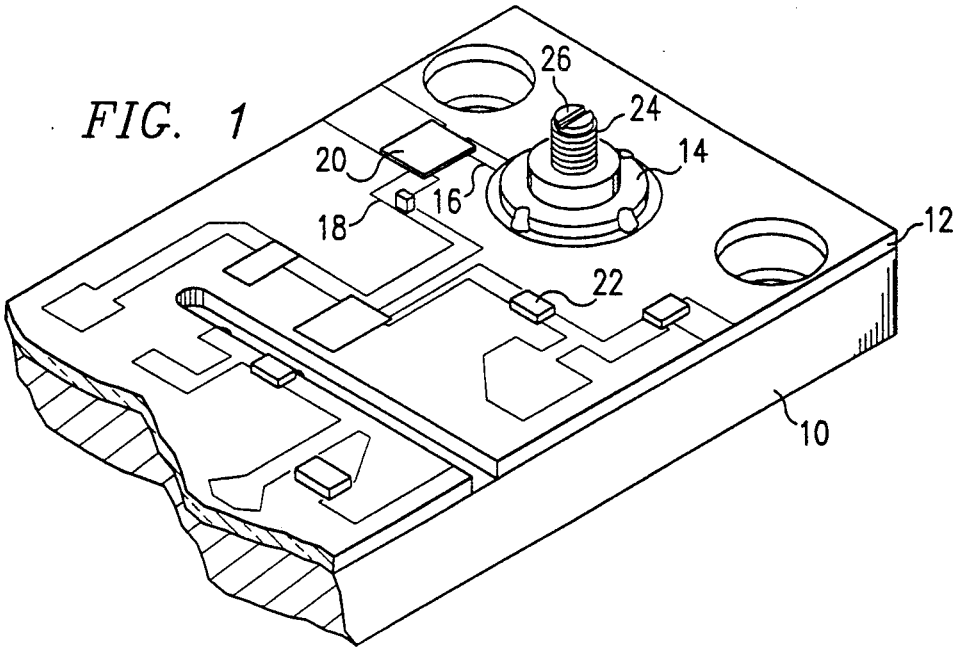
FIG. 1 is an isometric view of the adjusting portion of a power coupler electrically and mechanically engaged with a threaded electrical terminal on a microwave circuit.

In FIG. 1 a metal base 10 for a microwave or other electrical circuit substrate 12 is shown with a threaded terminal 14 silver soldered or otherwise attached to a circuit path 16 on the substrate 12. Various additional electrical circuit paths such as 18 are illustrated with components such as 20 and 22 comprising part of an electrical circuit for receiving a coupled electrical signal. A threaded stub 24 is shown extending from the threaded terminal 14 with a screwdriver engaging slot 26.

Figure 2:
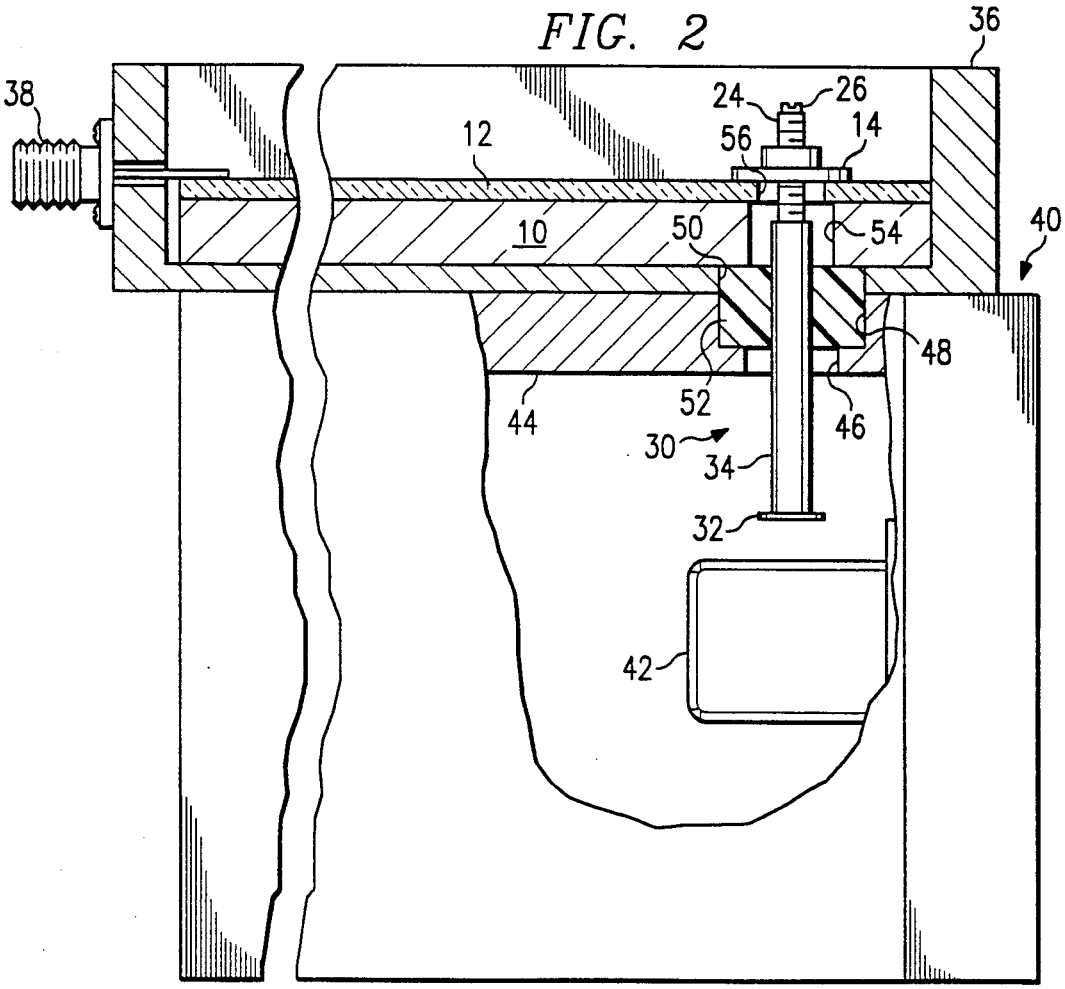
FIG. 2 is a side view of an electrical circuit, a power coupler threadedly connected thereto as a first holding device, a dielectric second holding device to prevent lateral movement of the power coupler and a field generating means as a composite unit.

In FIG. 2 the same designations are used as used in FIG. 1 where applicable. Thus, a coupler generally designated as 30 is shown with a coupling head 32, a main shaft portion 34 and the threaded portion 24 as previously designated threadedly engaging the threaded electrical terminal 14 attached to one surface of the substrate 12 which is mounted on the base plate 10. The substrate 12 and the base plate 10 are contained in a U-shaped box designated as 36 having an electrical connector 38 shown mounted at one end. Although not shown, a cover would typically complete the enclosure of circuitry within box 36. Box 36 is physically mounted on top of another box designated as 40. A cut-out is shown in the side of box 40 so that the coupler 30 can be observed as well as a resonator or field generating device 42. An upper portion or plate of box 40 is designated as 44. Upper plate 44 has a first diameter opening designated as 46 and a second diameter opening designated as 48. The U-shaped container 36 has an opening in the base thereof designated as 50. Opening 50 is the same diameter as opening 48 and is coaxial therewith. A dielectric 52 is shown placed within the openings 50 and 48 and dielectric 52 completely surrounds shaft 34 of coupler 30. The shaft 34 is slightly larger than an opening in dielectric 52 when the dielectric 52 is in an unstressed condition when no force is applied to the walls of the central opening in dielectric 52. In other words, there is a force fit of the shaft 34 into a central opening of dielectric 52. The dielectric 52 has an outer diameter which is very close to the diameter of openings 48 and 50 such that there can be no lateral movement of dielectric 52 within the openings. An opening 54 is shown in base 10 and an opening 56 is shown in substrate 12. The opening 54 is the same diameter as opening 46. The distance between the edges of opening 56 and the threaded portion 24 of coupler 30 is not critical since the substrate is not at ground potential and therefore does not create a substantial signal distorting discontinuity.

OPERATION OF THE INVENTION

The operation of the present invention is very straightforward. The oscillator or resonator 42 produces an electromagnetic field of alternating amplitude signals. The coupler head 32 picks up a signal of an amplitude depending upon the intensity of the field to which it is subjected. The intensity varies as a function of the distance from the surface of resonator 42 and thus, the amount of power in coupler 30 can be adjusted by moving the coupling head 32 closer to or farther away from resonator 42. This may be accomplished by inserting a screwdriver in slot 26 so as to move the shaft 34 in a vertical direction. The threaded portion 24 would normally be an extension of the shaft 34 rather than a separate part. It may be noted that while in the prior art, any threaded sections of the power couplers were at ground potential, the threaded stub 24 in the present invention carry the signal. In other words, the entire coupler 30 is a signal carrying device which is insulated from ground by the air or the dielectric 52. Since air and dielectric have different dielectric constants, the distance between the surface of the shaft 34 of coupler 30 and ground represented by the various parts 10, 36 and 44 need to be adjusted in accordance with well-known formulas for characteristic impedance from any of many textbooks such as that found in section 24 on transmission lines in Referenced Data for Radio Engineers. Air is generally considered to have a relative dielectric constant of 1.0 and for one embodiment of the invention, the dielectric was considered to have a relative dielectric constant of 2.08. Using standard formulas as set forth in the reference along with the diameter of the shaft, information can be obtained as to the proper distance between shaft 34 and ground to provide a given impedance. Since, in one embodiment of the invention, the impedance in the electrical circuit as shown on FIG. 1, was 50 ohms, the distances between the threaded portion 24 and substrate 12 and the distance between shaft 34 and the remaining ground portions 10, 36 and 44 were adjusted to maintain the same impedance up to the lower surface of plate 44. While it is reasonably straightforward to compensate for reflections caused by one impedance change as presented here, multiple impedance changes are to be avoided where possible.

Since the coupling device 30 is supported not only at the area of the terminal 14 by the cooperation between threads on the extension 24 and the threads within terminal 14, but additionally is supported by the dielectric 52 at a point remote from the threaded area, the coupler head 32 is very resistant to any lateral movement. While the microphonics generated in the prior art under vibration conditions rendered it totally unacceptable for the environment of the present invention, no microphonic distortion has been noted with the present invention. Further, the prior art concept required electrical connectors between the end of the coupler and the electrical circuit board. There is always insertion loss in the signal when a connector is used and such insertion loss is completely eliminated with the direct electrical connection between the threads on the portion 24 of coupler 30 and the threaded electrical terminal 14. The insertion loss that formed a part of the prior art not only was an electrical impedance but in many cases, was a disruption in or discontinuity in the characteristic impedance path and would cause further signal distortion due to signal reflections, etc.

At the frequencies involved for the present concept, the cable that would have to be used would be semi-rigid and lacking flexibility. Accordingly, it is difficult to accommodate such a cable in the confines allowed for the present invention. Thus, the direct electrical application of signal from the coupler to the printed circuit board via the threaded terminal 14 comprised an important technical advantage. In other words, the present concept not only is antimicrophonic but substantially reduces parts, the volume of space necessary to provide the connection from the coupler to the electrical circuit and in addition, reduces signal distortion by the elimination of potential points of discontinuity or signal reflection with connector interfaces as well as the signal loss due to the additional resistive interfaces.

We therefore wish to be limited not to the specific embodiment illustrated but only to the general concepts of reducing signal loss and signal distortion by having a direct connection from a power coupler to an electrical circuit and the concept of providing antimicrophonic capability or distortion reduction capability by supporting the coupler at two points while maintaining substantially constant impedance for a length of the coupler up to the electrical circuit which constant impedance is equal to that of the electrical circuit as claimed in the appended claims wherein we claim.

We claim:

1. A power coupling apparatus comprising:

a base including a first opening therein;

circuit means rigidly mounted on a first side of said base;

threaded means, solidly mounted on said circuit means, for electrically communicating with said circuit means;

resonator means, mounted on a second side of said base, for generating an alternating electric field;

dielectric material situated in said first opening, said dielectric material defining a second opening threaded rod means for detecting said alternating electric field and carrying a signal derived therefrom to said circuit means, said threaded rod means being engaged with said threaded means at a first end thereof, said threaded rod means preferably having an integral shaft portion being disposed securely through said second opening in said dielectric material, said threaded rod means further having a coupling head at a second end thereof substantially remote from said threaded means and coupled to said integral shaft portion, said coupling head operatively coupled to provide coupling between said coupling head and said resonator means;

enclosure means for substantially enclosing said threaded rod means so as to maintain a constant impedance along said rod means; and means for controllably changing said threaded rod means with respect to said threaded means so that said spaced relationship between said coupling head and resonator means is controllably changeable.

2. (New) The power coupling apparatus, as set forth in claim 1, wherein said rotatively turning means includes a screwdriver engaging slot defined on a tip of said first end of said threaded rod means.

3. The method of minimizing signal distortion in a power coupling device for supplying signals from said device to a microwave circuit and including a threaded first end and a coupling head end located adjacent to an alternating signal field supplying resonator, said power coupling device further having a shaft portion couple of between said first end and said coupling head end, the method comprising the steps of:

rigidly attaching a threaded receiver to said microwave circuit as a microwave circuit terminal;

contacting said threaded first end with said threaded receiver;

snugly enclosing the shaft portion of said power coupling device with dielectric material such that an impedance between the shaft portion and a ground approximates an impedance associated with said microwave circuit attached to said microwave circuit terminal; and enclosing the shaft portion in an enclosure of a predetermined size so as to maintain a constant impedance along the shaft portion and to match said impedance thereof with that of said microwave circuit.

4. The method, as set forth in claim 3, further comprising the step of controllably adjusting the distance between said coupling head end of said power coupling device and said alternating signal field supplying resonator by turning the threaded end of the device in said threaded terminal.

5. The method of minimizing signal distortion in a power coupling device for supplying signals from the device to a microwave circuit and including a threaded end, a coupling head end located adjacent to an alternating signal field supplying resonator and a center shaft portion disposed between said threaded end and coupling head, comprising the steps of:

rigidly attaching the threaded end of said coupling device to a threaded microwave circuit terminal; and enclosing said center shaft portion of said power coupling device at a preselected point with preselected amount of a dielectric material to maintain a substantially constant impedance throughout a predetermined length of said center shaft portion from said enclosure to the microwave circuit terminal.

6. Apparatus for varying power coupling between an electromagnetic field generator and a signal receiving circuit comprising, in combination:

a base;

an electrical circuit including a threaded signal input circuit terminal mounted in said base;

said electromagnetic field generator mounted in said base for generating an electromagnetic field;

an elongated coupler, having a threaded end, at a first end and engaging said threaded circuit terminal, said coupler further having an intermediate shaft coupled to said threaded end and a coupling head coupled to said intermediate shaft, said coupling head electrically coupling with said electromagnetic field; and anti-microphonic means, located in a portion of said base, snugly enclosing said intermediate shaft of said elongated coupler.

7. The method of varying power coupling between a resonator and a microwave receiving circuit comprising the steps of:

defining a threaded terminal in said microwave receiving circuit;

coupling a threaded end of an elongated coupler into said threaded terminal, said coupler also having an intermediate shaft coupled to said threaded end and a coupling head coupled to said intermediate shaft, said coupling head operatively coupled to provide coupling between said coupling head and said resonator;

snugly enclosing the intermediate shaft within a dielectric; and enclosing said intermediate shaft in an enclosure of a predetermined size so as to maintain a constant impedance along said intermediate shaft and to match an impedance associated with said microwave circuit.

8. Apparatus for varying power coupling between a resonator and a microwave receiving circuit comprising, in combination:

a housing;

a microwave circuit including a threaded microwave circuit terminal mounted in said housing;

a resonator mounted in said housing;

an elongated coupler for electrically coupling with said resonator and having a threaded end at a first end thereof for engaging said microwave circuit terminal, said coupler further having an integral coupling head at a second end thereof, said coupling head operatively coupled to provide coupling between said coupling head and said resonator, said elongated coupler further having a center shaft portion extending between said threaded end and coupling head; and a dielectric material, located in a portion of said base, snugly enclosing said center shaft portion of said elongated coupler.

* * * * *